US006681814B1

(12) United States Patent
Bartlett et al.

(10) Patent No.: US 6,681,814 B1
(45) Date of Patent: Jan. 27, 2004

(54) HAZARDOUS AREA POWER INTERLOCK

(75) Inventors: Jack F. Bartlett, Greensboro, NC (US); Howard M. Myers, Greensboro, NC (US); Russel D. Leatherman, Ramona, CA (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 10/200,362

(22) Filed: Jul. 22, 2002

(51) Int. Cl.[7] ..... B65B 1/30
(52) U.S. Cl. ..... 141/94; 141/96
(58) Field of Search ..... 141/94, 95, 96, 141/59, 83, 290, 392; 340/632; 222/129, 23

(56) References Cited

U.S. PATENT DOCUMENTS

| | | | | |
|---|---|---|---|---|
| 3,720,935 A | | 3/1973 | Tomlin, Jr. | 340/248 R |
| 4,209,712 A | | 6/1980 | Westlund | 307/118 |
| 4,410,949 A | | 10/1983 | Huellinghorst et al. | 364/465 |
| 4,986,445 A | | 1/1991 | Young et al. | 222/71 |
| 5,189,392 A | | 2/1993 | Kass et al. | 340/521 |
| 5,209,275 A | | 5/1993 | Akiba et al. | 141/83 |
| 5,319,545 A | | 6/1994 | McGarvey et al. | 364/403 |
| 5,400,253 A | | 3/1995 | O'Connor | 364/442 |
| 5,423,457 A | | 6/1995 | Nicholas et al. | 222/62 |
| 5,602,754 A | | 2/1997 | Beatty et al. | 364/489 |
| 5,717,564 A | | 2/1998 | Lindale | 361/600 |
| 5,782,275 A | | 7/1998 | Hartsell, Jr. et al. | 141/94 |
| 5,828,307 A | * | 10/1998 | Washer | 340/632 |
| 5,832,967 A | | 11/1998 | Andersson | 141/59 |
| 5,851,108 A | | 12/1998 | Clymer et al. | 417/44.1 |
| 5,867,403 A | * | 2/1999 | Sasnett et al. | 141/192 |
| 5,874,787 A | | 2/1999 | Meyer et al. | 307/39 |
| 5,925,130 A | | 7/1999 | Frame et al. | 713/300 |
| 6,065,638 A | | 5/2000 | Terranova et al. | 222/1 |
| 6,196,065 B1 | | 3/2001 | Henksmeier et al. | 73/261 |
| 6,218,951 B1 | | 4/2001 | Colvin | 340/635 |
| 6,357,493 B1 | | 3/2002 | Shermer et al. | 141/59 |
| 6,442,448 B1 | * | 8/2002 | Finley et al. | 700/231 |

* cited by examiner

*Primary Examiner*—Gregory Huson
*Assistant Examiner*—Khoa D. Huynh
(74) *Attorney, Agent, or Firm*—Withrow & Terranova PLLC

(57) ABSTRACT

A fuel dispenser contains a vapor sensor in the non-hazardous electronics chamber. The vapor sensor is operatively connected to a power interlock. When hydrocarbon vapors exceed a predetermined threshold in the electronics chamber, power is decoupled from the electronics in the electronics chamber to prevent explosions. The power interlock may further decouple power from the entire fuel dispenser. The detection of hydrocarbon vapors may also be communicated to another system including a remote location.

25 Claims, 3 Drawing Sheets

HAZARDOUS AREA POWER INTERLOCK

FIELD OF THE INVENTION

The present invention relates to vapor detection associated with a fuel dispenser, and more particularly to vapor detection in the electronics cabinet portion of the fuel dispenser.

BACKGROUND OF THE INVENTION

Fuel dispensers, whether gasoline, natural gas, propane, or the like, are getting more complex with time. As a result, increasingly complex electronic circuits are required. As with any electrical component, there is always a chance, albeit slim, of sparking from the electronic circuits. Sparks and fuel vapors may cause a hazardous condition, such as an explosion. To address the potential for this problem, most, if not all, fuel dispenser manufacturers separate the interior of the fuel dispenser into two chambers.

A first hazardous area chamber comprises fuel-handling devices, such as flow meters, pumps, valves, and the like. Fuel dispenser chambers are required to comply with Class 1, Division 1 rules specifying that the electrical connections must use explosion-proof connections and/or terminal boxes. The National Electric Code Handbook, Section 514, details one set of regulatory requirements that are in place for such devices.

A second chamber, typically above the Class 1, Division 1 area, contains the main electronic components of the fuel dispenser, such as payment acceptors, remote communication devices, display circuits, keypad circuitry, and the like. A vapor barrier is frequently positioned between the two chambers to prevent vapor from passing from the fuel-handing hazardous chamber to the electronics chamber. A potted conduit may be used to prevent vapors from contaminating the electronics chamber. Further information about vapor barriers may also be found in U.S. Pat. No. 4,986,445, which is hereby incorporated by reference. Wiring and fuel delivery conduits that extend through the vapor barrier typically have seals therearound to keep the vapor barrier intact.

Typical seals comprise potting solutions, rubber seals, and the like, which may deteriorate over time, may be improperly installed, or otherwise fail, allowing for the potential of hydrocarbon vapors to pass into the electronics chamber and potentially increase the risk of sparks igniting the vapor. Thus, the need for additional safety measures to reduce the risk associated with vapor entering the electronics chamber of the fuel dispenser continues.

SUMMARY OF THE INVENTION

The present invention addresses these safety concerns by placing a vapor sensor within the electronics chamber of the fuel dispenser. If the vapor sensor detects the presence of hydrocarbon vapors, or alternatively, changes in the amount of oxygen vapor indicative of hydrocarbon vapor presence, power is decoupled from the electronic components of the fuel dispenser, thus reducing the likelihood of sparking that could cause vapors to combust, ignite, or explode.

Alternate embodiments comprise using a plurality of sensors and/or keeping a log of sensor readings to verify functionality, deviations from calibrations, and the like.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
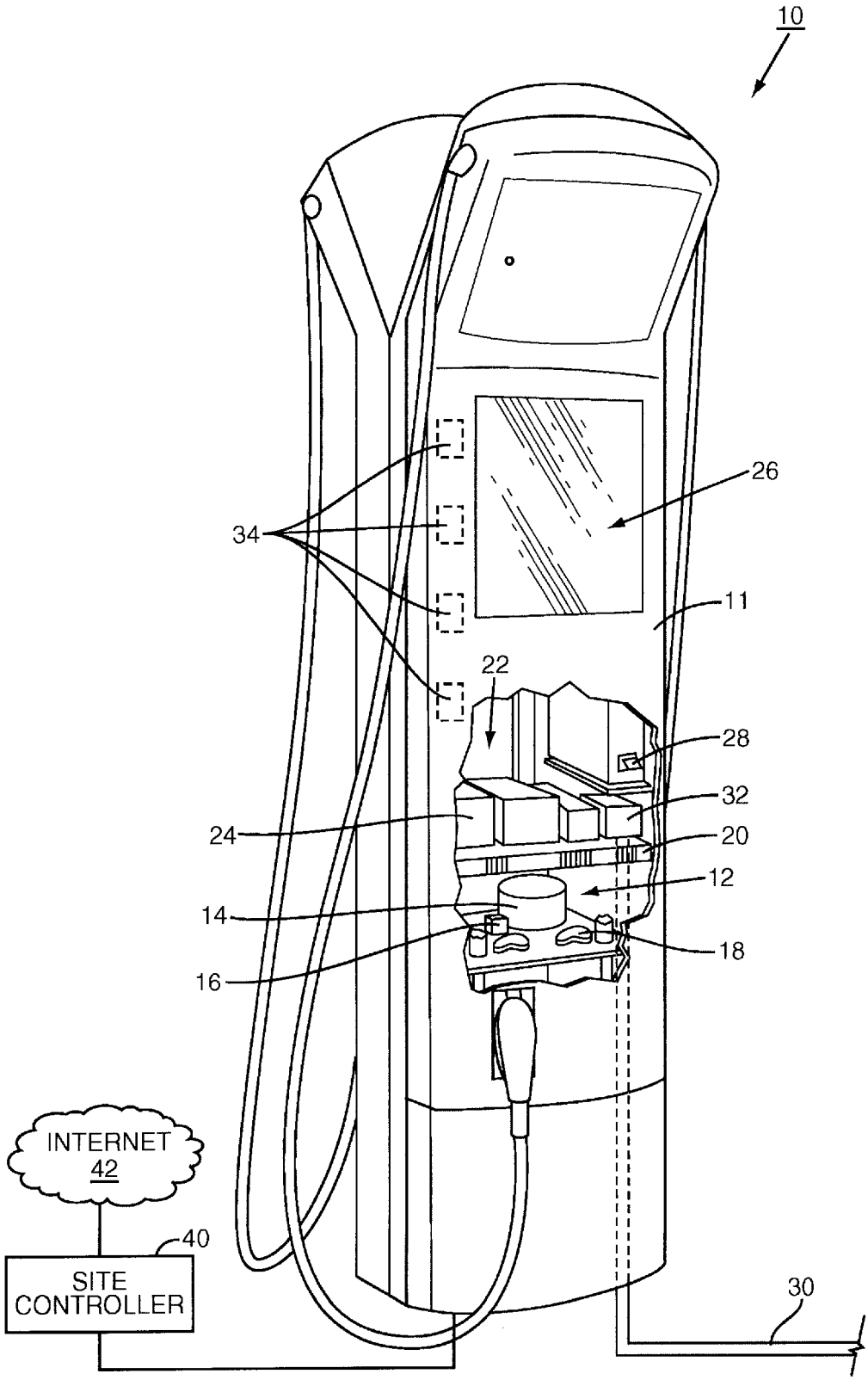
FIG. 1 illustrates a fuel dispenser with a cutaway view of the internal mechanisms thereof as used in an exemplary embodiment of the present invention.

FIG. 1 illustrates a fuel dispenser 10 such as may be used with the present invention. Such a fuel dispenser 10 may be the ECLIPSE® manufactured and sold by assignee of the present application, although almost any type of fuel dispenser may be used with the present invention. The fuel dispenser 10 is shown with a housing 11 partially cut away to illustrate the first chamber 12, which comprises a fuel pump 14, a fuel meter 16, and other fuel-handling devices 18, which are well understood in the art. Any electrical connections or terminal boxes within the first chamber 12 are required to comply with the National Electronics Code (NEC) regulations found in section 500 for a Class 1, Division 1 area for explosion prevention. U.S. Pat. No. 5,717,564, incorporated herein by reference, discusses more information on Class 1, Division 1 areas in a fuel dispenser. Typically, these electrical connectors must be enclosed in an explosion-proof housing. For a further explanation of the internal components of a fuel dispenser, reference is made to commonly assigned U.S. Pat. Nos. 5,602,754; 6,357,493; 6,196,065; and 6,065,638, which are all hereby incorporated by reference in their entirety.

A vapor barrier 20 may be positioned superiorly of the first chamber 12 and preclude fuel vapor emissions from the fuel-handling components positioned within the first chamber 12 from entering a second chamber 22. Information about vapor barriers may be found in the previously incorporated U.S. Pat. No. 4,986,445. The second chamber 22 may be positioned above the vapor barrier 20 and may comprise an electronics chamber with a controller 24, display electronics 26, payment acceptor electronics 28, and the like, as is well understood in the art. The electrical connections in the second chamber 22 are typically not explosion-proof, nor are they enclosed in explosion-proof housings. An unbroken conduit (not shown explicitly) conveys the fuel through the space proximate the second chamber 22 to the top of the fuel dispenser 10 for dispensing through the external hose and nozzle as is well understood. Because the conduit is unbroken, a slightly different type of protection exists for these conduits. Namely, a Class 1, Division 2 level (as defined by the NEC) of protection is afforded these fuel lines. However, it is possible, albeit very unlikely, that fuel vapors may escape from these conduits to the second chamber 22. Fuel vapors may also be generated in a blending apparatus or other fuel handling device positioned within the top of the fuel dispenser 10.

Power is supplied to the electrical components within the fuel dispenser 10 by power line 30. The present invention associates a power interlock 32 with the power line 30. An exemplary power interlock 32 is illustrated in U.S. Pat. No. 5,925,130, which is hereby incorporated by reference in its entirety. Other power interlocks may also be used as needed or desired. Power interlocks may be associated with the fuel dispenser 10 for other reasons. For example, some fuel dispensers 10 may have a power interlock that detects collisions and removes power from the fuel dispenser 10 in the event a vehicle collides with the fuel dispenser.

The present invention places a vapor sensor 34 within the second chamber 22. The vapor sensor 34 is operatively connected to the power interlock 32. In one embodiment, the vapor sensor 34 is connected to the controller 24, and the controller 24 is connected to the power interlock 32. In an alternate embodiment, the vapor sensor 34 may comprise a dedicated controller and memory associated therewith to control the power interlock 32 directly. If the vapor sensor 34 detects a level of vapor above a predetermined acceptable threshold, the vapor sensor 34 (either directly or indirectly) causes the power interlock 32 to decouple power to the fuel dispenser 10, or at least the electronic components of the second chamber 22, thereby reducing the risk of spark-fuel vapor interaction.

The vapor sensor 34 may be a pellistor, a chemical film sensor, a semi-conductor sensor, a tin oxide sensor, an infrared (IR) sensor, or the like. Additionally, while this embodiment discloses a vapor sensor 34 that senses the presence of hydrocarbon vapor, an alternate embodiment detects a decrease in oxygen or nitrogen levels, and from that decrease infers an increase in the presence of hydrocarbon vapors. Still other indirect sensing technologies are available and suited for use with the present invention. Exemplary vapor sensor patents include U.S. Pat. Nos. 5,782,275 and 5,832,967, both of which are hereby incorporated by reference in their entirety.

Thus, a "vapor sensor" as defined herein, in its broadest form, is a sensor that is capable of allowing the determination of the presence or absence of fuel vapor. The output of the vapor sensor 34 may be a voltage or current level that may be interpreted to determine the level of fuel vapor within the second chamber 22. This interpretation may require a "zero" and "span" calibration as is well understood. This calibration may be done by sequential logic circuits or with the aid of the controller 24.

In the embodiment in which the vapor sensor 34 directly controls the power interlock 32, the vapor sensor 34 may be associated with additional circuitry, memory, and software to provide the functionality of the present invention. In the embodiment in which the vapor sensor 34 reports a measurement to the controller 24, the controller 24 may have the memory and software to provide the functionality of the present invention.

In another embodiment, as illustrated in FIG. 1, multiple vapor sensors 34 may be positioned at various locations within the second chamber 22. Multiple vapor sensors 34 may be used for redundancy purposes and/or leak detection purposes. With an array of vapor sensors 34, leak location may be approximated as the vapor sensor 34 closest to the leak may be the first to detect leaking vapor or have the highest level of detected hydrocarbons. To this end, measurements taken by the vapor sensors 34 may be stored in memory along with a time stamp so that this data may be analyzed. Where there is an array of vapor sensors 34, the measurement data may be indexed by a locational identifier to distinguish between data from different vapor sensors 34.

While a vertical array of vapor sensors 34 is illustrated in FIG. 1, a horizontal array or a matrix array may also be used. Additionally, the vapor sensors 34 may preferably be positioned proximate any place through which wiring passes from the second chamber 22 to the first chamber 12, as such locations are more likely to experience failure and thus leak fuel vapors into the second chamber 22. In any event, fuel vapor levels exceeding a predetermined threshold detected by any of the vapor sensors 34 will trigger the power interlock 32 to decouple power to the electronic components of the fuel dispenser 10.

As might be expected, the fuel dispenser 10 communicates with a site controller 40 and perhaps a remote network 42 over long distance communication networks such as the Internet. This communication may be through any number of communication links and protocols such as TCP/IP, a proprietary protocol, or the like, and is well understood.

Figure 2:
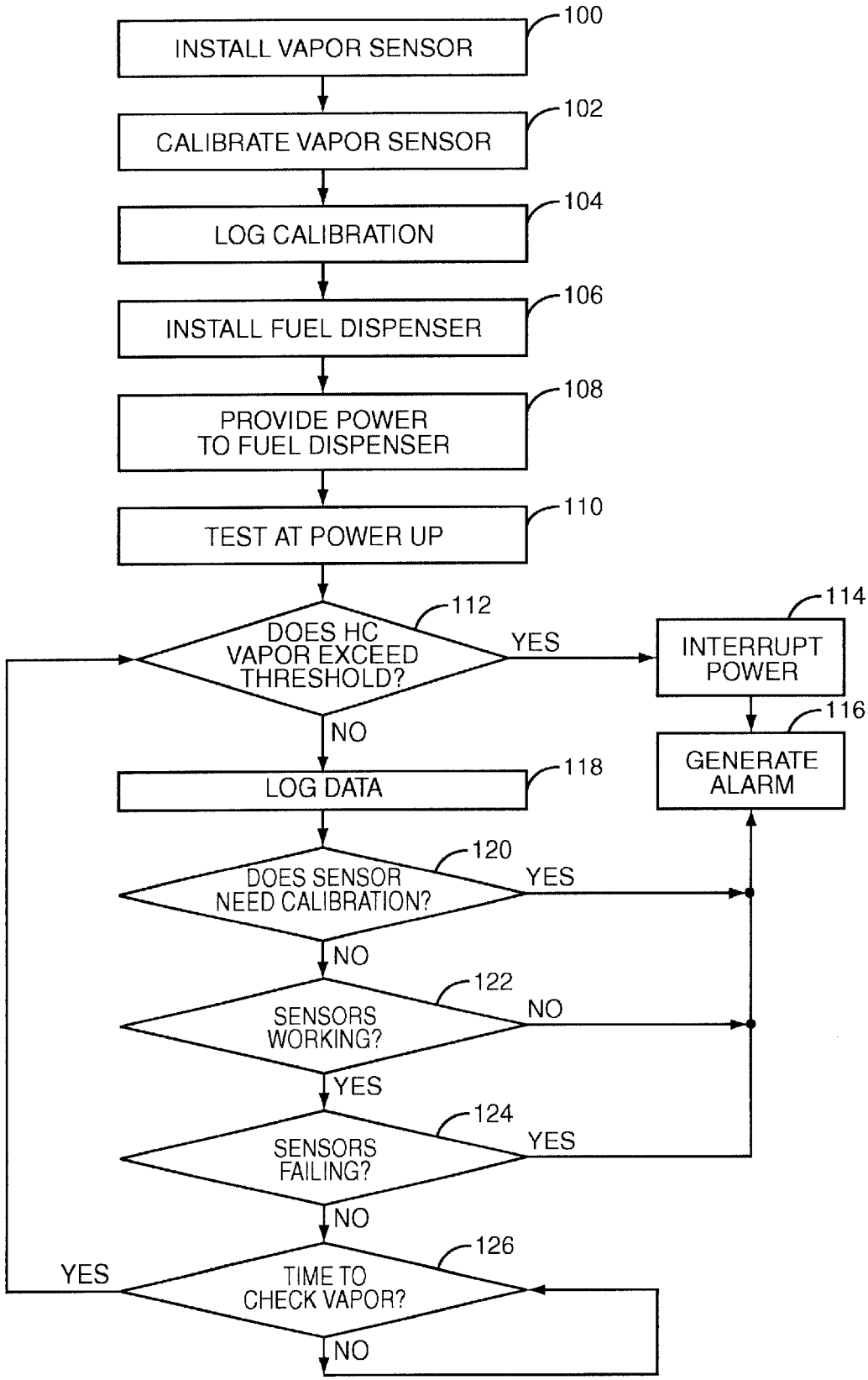
FIG. 2 illustrates a flow chart demonstrating the logic paths of an exemplary embodiment of the present invention.

There are numerous permutations on the functionality that may be implemented with the present invention as illustrated in FIG. 2. Initially, the vapor sensor 34 is installed in the fuel dispenser 10 (block 100). The vapor sensor 34 is calibrated (block 102). While the calibration may be considered optional, it is typically preferred. As noted, this may involve providing the vapor sensor 34 a "zero" point and a range of hydrocarbon vapor levels while measuring the output of the vapor sensor 34. This may be stored in a look-up table or the like as needed or desired. "Zero" in this case may be a relative zero rather than an absolute zero. A log of the calibration may be kept (block 104) as well.

The fuel dispenser 10 is installed in the field (block 106). This is a conventional process, although the power coupling must be routed through the power interlock 32. However, this may be seamless to the individual installing the fuel dispenser 10. Power is then provided to the fuel dispenser 10 (block 108). This may be done by turning a circuit breaker, plugging in the fuel dispenser 10, or other equivalent technique as is well understood. Note that the present invention may be retrofit onto existing fuel dispensers 10 that have already been deployed. While the order of the steps may change, the fundamental operation of the vapor sensor 34 and the power interlock 32 does not. Such changes in the order of the steps are trivial to one of ordinary skill in the art in light of the present disclosure.

The vapor sensor 34 tests the vapor level upon first receiving power (block 110). The vapor sensor 34 outputs either a current level or voltage level indicative of a detected vapor level within the second chamber 22. A determination is made whether the hydrocarbon vapor exceeds a predetermined threshold (block 112). If the hydrocarbon vapor does exceed the threshold, then the power interlock 32 is instructed to interrupt power to the fuel dispenser 10 (block 114), and an alarm may be generated (block 116). The alarm may be audible, visual, or some combination thereof. In one embodiment, the alarm is local to the fuel dispenser 10. In a second embodiment, the alarm is routed to a remote location such as site controller 40 or through the Internet 42 to still another remote location. Still further, the alarm may be generated by a site controller 40 or other remote computer polling the fuel dispenser 10 and not receiving a response because the fuel dispenser 10 has been depowered.

If, however, the vapor detected does not exceed the predetermined threshold, the measurements may be logged (block 118). As noted above, such a log may comprise a measurement, a time stamp, and a vapor sensor 34 identification as needed or desired.

Using the log of data, the controller 24 may determine if the sensors 34 need calibration (block 120). If block 120 is answered affirmatively, an alarm may be generated (block 116). Optionally, power may be decoupled from the fuel dispenser 10 as a precautionary measure. To determine if the sensors 34 need calibration, the latest data from the vapor sensor 34 may be compared to historical data; a time stamp may be compared to an expected life expectancy of the calibration in light of known wear patterns on the vapor sensors 34 or other technique as is well understood.

Additionally, the controller 24 may use the log of data to determine if the vapor sensors 34 are working (block 122). For example, if no reading is present at all from the vapor sensor 34, the readings are at wide variation from an expected reading, or a reading at wide variation from readings from other vapor sensors 34 is present, the vapor sensor 34 may not be working. If the vapor sensor(s) 34 is(are) not working, an alarm may be generated (block 116) and optionally power decoupled from the fuel dispenser 10.

Still further, the controller 24 may, using the log of data, determine if the vapor sensor(s) 34 is(are) failing (block 124). This may be done by comparing the time stamps to an empirically derived life expectancy threshold, a series of increasingly errant readings, or the like as is needed or desired. If the vapor sensor(s) 34 is(are) failing, an alarm may be generated.

A clock or the like associated with the controller 24 may determine if it is time to check the vapor levels (block 126). This may be done by comparing the time stamp on the last reading to a clock, by calculating a time elapsed, or the like as needed or desired. If the answer is no, the process repeats as indicated. If the answer is yes, the process repeats at block 112. Note that the frequency with which the vapor is checked may vary as needed or desired. In one embodiment, the vapor levels are automatically checked periodically. In another embodiment, the vapor levels are checked by manual intervention and instruction.

Note that while blocks 118–126 are described as being performed by the controller 24, these steps may equivalently be performed by a microprocessor or sequential logic associated directly with the vapor sensor 34, or even by a site controller 40 or other remote computer that performs these functions for a plurality of fuel dispensers 10 in a fueling environment. Such distributed tasking is not preferred as it places increased signaling burdens on the networks within the fueling environment, but it is possible.

Note further that the precise order of the steps need not be as linear as indicated and that those skilled in the art will recognize variations that still fall within the scope of the invention. For example, not every determining step 120–124 need be completed every time the vapor level is checked. Likewise, the determining steps 120–124 may be tied to internal clocks independent of the vapor checking. For example, the sensors-working determination could be once a day; the sensors-failing determination once a week; and the sensors-need-calibration determination once a month. Other time periods are also possible.

While not shown explicitly as part of the flow chart in FIG. 2, the present invention may also temporarily suspend the functioning of the vapor sensor 34 to allow for high voltage leakage checks of site wiring.

Figure 3:
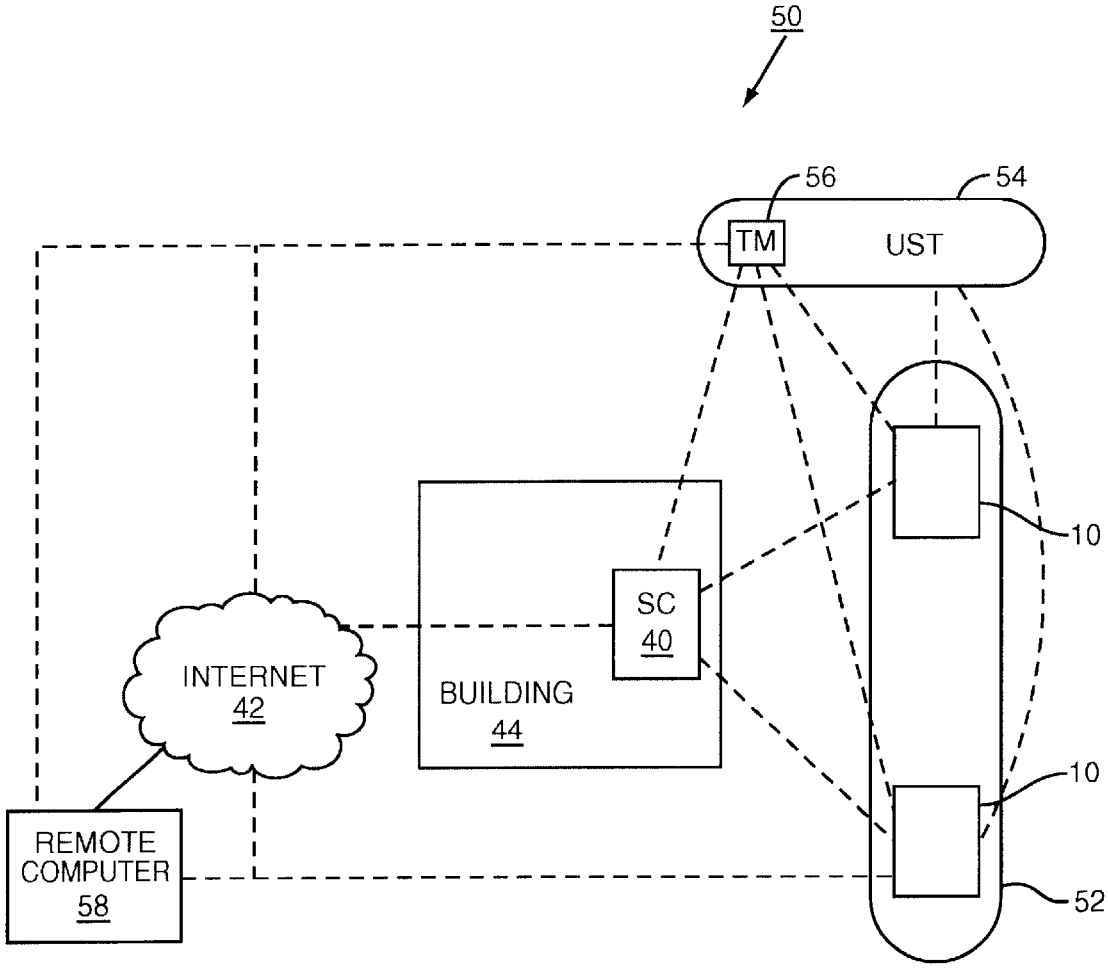
FIG. 3 illustrates a fuel dispenser as positioned in a fuel dispensing environment.

FIG. 3 illustrates a fueling environment 50 that further illustrates alternate embodiments of the present invention. Fueling environment 50 comprises one or more fuel dispensers 10, which may be positioned on an island 52 as is conventional. While it is particularly contemplated that the fuel dispensers 10 will dispense gasoline or diesel fuel, other vapor generating fuels such as propane, natural gas, or the like may also be dispensed. The fuel dispensers 10 receive fuel from an underground storage tank (UST) 54 that has a tank monitor 56 associated therewith.

The fuel dispensers 10 and the tank monitor 56 may communicate with the site controller 40. The site controller 40 may be positioned within a building 44 within the fueling environment 50 as is well understood. Alternatively, the fuel dispensers 10 and the tank monitor 56 may be connected directly to a communications network such as the internet 42. As yet another alternative, the fuel dispensers 10 and the tank monitor 56 may be directly connected to a remote computer 58. In a contemplated embodiment, the remote computer 58 may be a computer associated with the manufacturer or distributor of the fuel dispensers 10 or the tank monitor 56.

The tank monitor 56 may be one such as those sold by Veeder-Root and as exemplified in U.S. Pat. Nos. 5,423,457; 5,400,253; and 5,319,545, which are hereby incorporated by reference in their entireties. The tank monitor 56 may communicate with the fuel dispensers 10. The various communications within the fueling environment 50 may be over a LAN, a wireless LAN, serial communications between the entities, master-slave relationships, daisy chain relationships, or the like as needed or desired, and may use any appropriate protocol.

In contrast to the earlier embodiment, the embodiments of FIG. 3 may remove the decision-making from within the fuel dispenser 10 and vest such decision-making with an entity removed therefrom. Specifically contemplated embodiments vest the decision-making with the site controller 40, the tank monitor 56, or the remote computer 58. However, these are not preferred as they may add traffic to the interstitial networks connecting the elements and may result in delays before the command is sent to the power interlock 32 to decouple the power from the electronics within the fuel dispenser 10.

The measurement data may be sent to a remote location of collation and processing as needed while preserving memory space in the fuel dispenser 10. Depending on the precise communication topology of the fueling environment 50, the fuel dispenser 10 may send the data first to the tank monitor 56 and thence to the remote computer 58, first to the site controller 40 and thence to the remote computer 58; directly to the remote computer 58; or the like as needed or desired. Tank monitors 56 already have communicative links to remote computers 58 to report pressurization levels, fugitive emissions, and the like, so sending the data relating to vapor within the second chamber 22 may be compiled therewith as needed or desired.

Those skilled in the art will recognize improvements and modifications to the preferred embodiments of the present invention. All such improvements and modifications are considered within the scope of the concepts disclosed herein and the claims that follow.

What is claimed is:

1. A fuel dispenser, comprising:

a housing, comprising:

an electronics chamber containing electronics for performing functions associated with the fuel dispenser; and a fuel-handling chamber, said fuel handling chamber generating fuel vapors, said fuel-handling chamber isolated from said electronics chamber; and a vapor sensor for detecting said fuel vapors within said electronics chamber.

2. The fuel dispenser of claim 1, further comprising a power interlock, said power interlock interrupting power to said electronics if said vapor sensor detects said fuel vapors within said electronics chamber.

3. The fuel dispenser of claim 1, wherein said vapor sensor detects hydrocarbon vapors.

4. The fuel dispenser of claim 1, wherein said vapor sensor detects an absence of oxygen.

5. The fuel dispenser of claim 1, wherein said vapor sensor comprises a sensor selected from the group consisting of: a pellistor, a semiconductor sensor, a chemical film sensor, an IR sensor, and a tin oxide sensor.

6. The fuel dispenser of claim 1, wherein said fuel handling chamber comprises at least one vapor handling component that contains fuel vapors.

7. The fuel dispenser of claim 1, wherein said vapor sensor detects an oxygen level and infers the presence or absence of fuel vapors based on said oxygen level.

8. The fuel dispenser of claim 1, further comprising a remote communications device for communicating with a remote location selected from the group consisting of: a site controller, a tank monitor, and the Internet.

9. The fuel dispenser of claim 2, wherein said power interlock interrupts power to said electronics if said vapor sensor detects said fuel vapors above a predetermined threshold.

10. The fuel dispenser of claim 2, wherein said power interlock interrupts power to the entire fuel dispenser.

11. The fuel dispenser of claim 1, further comprising a controller and a memory, said memory storing data associated with readings made by said vapor sensor.

12. The fuel dispenser of claim 11, wherein said controller determines if said vapor sensor is working.

13. A method of using a fuel dispenser, comprising:

installing a vapor sensor in an electronics chamber of the fuel dispenser distinct from a fuel-handling chamber of the fuel dispenser; and sensing fuel vapor within the electronics chamber to determine if said fuel vapor has infiltrated said electronics chamber.

14. The method of claim 13, further comprising decoupling power to said fuel dispenser if sensing vapor within the electronics chamber senses vapor above a predetermined threshold.

15. The method of claim 13, wherein sensing vapor within said electronics chamber comprises periodically sensing vapor within said electronics chamber.

16. The method of claim 13, further comprising calibrating said vapor sensor.

17. The method of claim 13, further comprising determining if said vapor sensor is working.

18. The method of claim 13, further comprising determining if said vapor sensor is failing.

19. The method of claim 13, further comprising determining if said vapor sensor needs calibration.

20. The method of claim 13, further comprising generating an alarm if said sensing fuel vapor within said electronics chamber senses an amount of fuel vapor above a predetermined threshold.

21. The method of claim 13, wherein sensing fuel vapor within said electronics chamber comprises sensing hydrocarbon vapors within said electronics chamber.

22. The method of claim 13, wherein sensing fuel vapor within said electronics chamber comprises sensing an absence of oxygen within said electronics chamber.

23. The method of claim 13, further comprising logging data associated with said vapor sensor.

24. The method of claim 13, further comprising sensing vapor levels upon initially powering the fuel dispenser.

25. The method of claim 13, wherein sensing vapor within the electronics chamber comprises sensing vapor with a sensor selected from the group consisting of: a pellistor, an IR sensor, a chemical film sensor, a tin oxide sensor, and a semiconductor sensor.

* * * * *